United States Patent [19]

Wilson

[11] 4,213,542

[45] Jul. 22, 1980

[54] TOOTH PASTE DISPENSER

[76] Inventor: Bobby R. Wilson, 468 Iroquois Ave., Akron, Ohio 44305

[21] Appl. No.: 18,591

[22] Filed: Mar. 7, 1979

[51] Int. Cl.[3] ..... B65D 35/28

[52] U.S. Cl. ..... 222/102; 222/105

[58] Field of Search ..... 222/101, 102, 105

[56] References Cited

U.S. PATENT DOCUMENTS

| | | | |
|---|---|---|---|
| 1,784,752 | 12/1930 | Ries | 222/102 |
| 2,037,138 | 4/1936 | McConnon | 222/102 X |
| 2,357,351 | 9/1944 | Oliver | 222/102 |
| 2,550,537 | 4/1951 | Derrick | 222/102 |
| 2,687,827 | 8/1954 | McGilchrist et al. | 222/102 X |
| 4,125,206 | 11/1978 | Wilson | 222/101 |

*Primary Examiner*—David A. Scherbel

[57] ABSTRACT

A device for containing and dispensing the contents within a collapsible tube. A plaque having affixed thereto a collapsible tube container, within the container is a frictional driven carriage with a horizontally adjustible roller.

1 Claim, 3 Drawing Figures

TOOTH PASTE DISPENSER

BACKGROUND

Previously there have been several devices proposed to dispense the contents of a collapsible tube, ranging from a plunger to an electro-magnet driven carriage. However, they were too costly, too complicated to be of any interest to the domestic market. However, the substitution of a friction dispenser is less costly and complicated to construct, as occurs in U.S. Pat. No. 3,313,454, wherein the rollers are permanently affixed, thus allowing no means of compensating for the varying tube thickness. Further, the casing consists of two parts which are held together by rods, screws and nuts, making it necessary to completely disassemble the device for insertion of a tube.

SUMMARY OF THE INVENTION

The object of the invention is to provide a device that is attractive and inexpensive to fabricate. A further object of the invention is to provide a frictionally driven carriage with horizontal adjusting means to allow for varying thicknesses of tubes. The device is designed so that the plaques, toothbrush holder, tube container and the vertical slots can be molded in one piece by injection molding out of synthetic material.

DETAILED DESCRIPTION OF THE INVENTION

Figure 2:
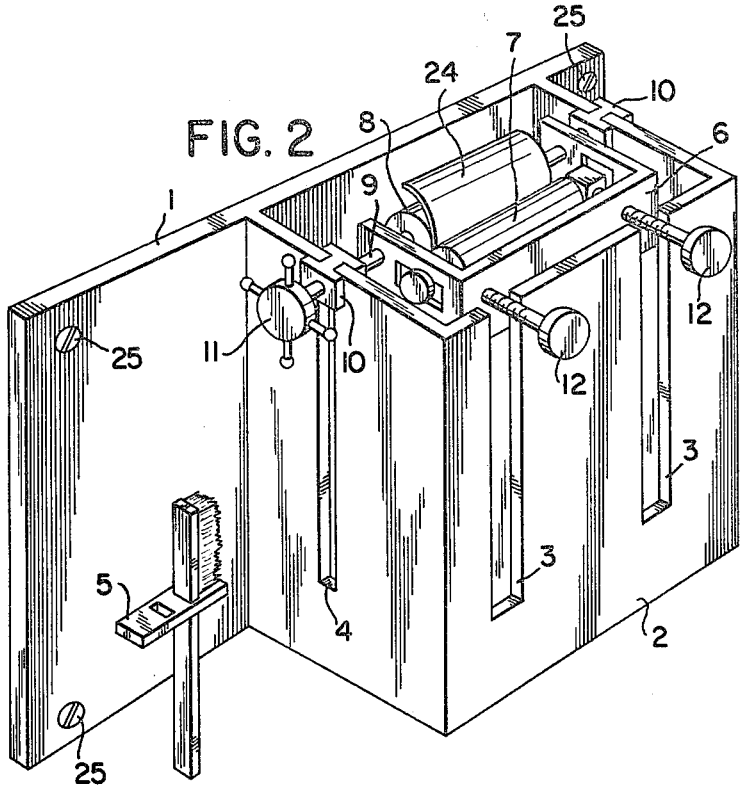
FIG. 2 is a front view of the entire invention.

Referring to FIG. 2, the device consists of a plaque indicated by numeral 1, having wall mounting means 25 in the form of screws, and a collapsible tube container 2 consisting of side and front walls having slots, side slots 4. Front slots 3 running vertically on the container, with the Plaque 1 forming the back of the container.

Figure 1:
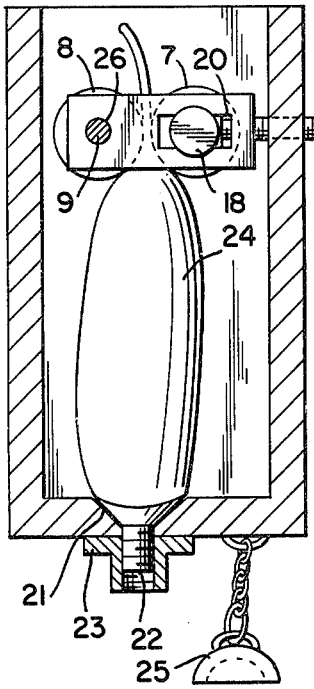
FIG. 1 is a cutaway side view of the invention.

Referring to FIG. 1, the bottom of the container has a hole 21 where collapsible tube 24 may protrude by the neck through the bottom of the container, being held in place by a collared nipple 23, with a threaded central opening matching the threads on the mouth 22 of a collapsible tube. A cap 25 is provided to slip over the mouth of the nipple whenever the contents of the collapsible are not being dispensed.

Figure 3:
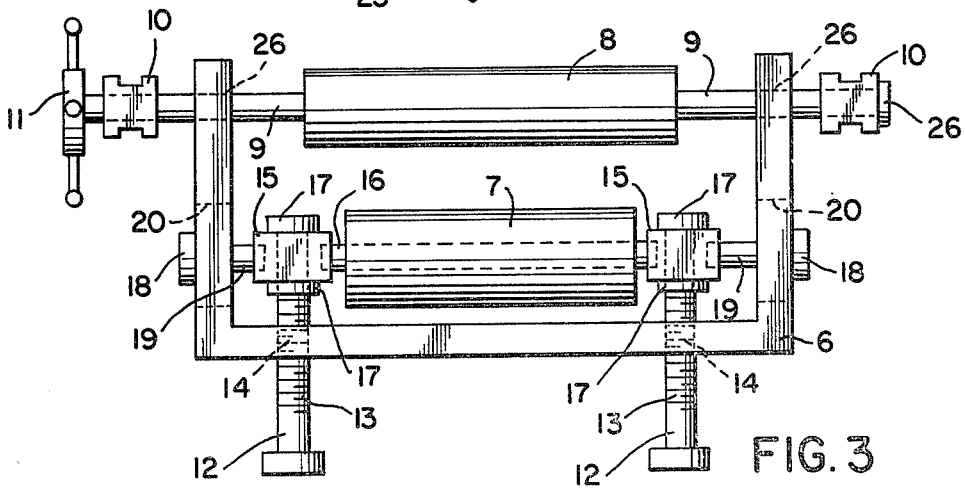
FIG. 3 is a view of the carriage, looking from the top.

Referring to FIG. 3, a friction driven carriage 6 provides means of dispensing the contents of a collapsible tube. Carriage 6 consists of side and front walls having two rollers rotationally mounted within the carriage. Roller 7 is mounted on an axle 16. Axle 16 is rotationally secured within adjusting joints 15. The adjusting joints 15 are slidably mounted within the elongated slots 20 in the carriage 6 by an axle 19 affixed to the outer side of the adjusting joints and extending through the elongated slots 20 in the carriage, and secured by caps 18. Means of adjusting the roller 7 within the elongated slots 20 adjusting screws 12 are provided. The adjusting screws (one on each side of the roller 7) are rotationally mounted through the adjusting joints, the adjusting screws then protrude through the threaded opening 14 in the carriage, matching threads 13 on the adjusting screws 12. The screws then continue through the elongated slots 3, running vertically on the front of the container 2.

The roller 8 is fixed to an axle 9 that is rotationally secured within the holes 26 that are stationary in the carriage. The axle then continues through the carriage 6 and through the I joints 10 to the outer side of the container, whereby one side of the I joint is capped 26, and the other a knob 11 is provided to drive the roller 8. The I joints 10 provide stability to the carriage by slidably fitting within the slots 4, running vertically on the side of the container 2.

MODE OF OPERATION

Place a collapsible tube between the rollers, adjust the roller 7 with adjusting screws 12, equally against the top of the tube, then place the carriage in the container with the I joint 10 fitting in the slots 4. The adjusting screws 12 in slots 3 and the mouth of the tube in the hole 21, whereby a collared nipple 23 is screwed on the mouth 22 of the tube. When knob 11 is turned it will drive the carriage vertically along the tube by friction contact with the tube.

I claim:

1. A dispensing device for dispensing the contents of a collapsible tube comprising:

(A) A plaque for mounting on the wall, having thereto affixed at least one toothbrush holder and a collapsible tube container;

(B) Said container having front, side and bottom walls with said plaque forming the back wall;

(C) Said front and side walls having elongated slots running vertically and aperture means in the bottom wall of the container;

(D) Said container having therein a vertically movable dispensing means, said dispensing means having front and side walls forming a carriage, said side walls having elongated slots and said front wall having a threaded opening; and (E) Said carriage including two rollers engaging a vertically disposable tube having one roller bearing means adjustable in a horizontal plane within said slots in said carriage by a threaded screw means passing through said slots in said container and being threadly received by said threaded opening in said carriage to provide adjustment movement to said one roller bearing means, a second roller affixed to an axle that is rotationally secured within said carriage, said axle continuing through the carriage and supported by "I" joints that move in a vertical plane in said slots in said side walls, said axle having thereto affixed a knob to drive said carriage in a vertical plane by friction contact with said vertical disposable tube.

* * * * *